United States Patent [19]

Heitmann et al.

[11] 4,400,223

[45] Aug. 23, 1983

[54] HOT ROLLED STEEL PRODUCT AND METHOD FOR PRODUCING SAME

[75] Inventors: William E. Heitmann, Crown Point; Richard J. Sulewski, Hebron, both of Ind.

[73] Assignee: Inland Steel Company, Chicago, Ill.

[21] Appl. No.: 294,908

[22] Filed: Aug. 21, 1981

[51] Int. Cl.[3] ..... C21D 8/02

[52] U.S. Cl. ..... 148/12 F; 75/123 E; 75/123 J; 148/36

[58] Field of Search ..... 148/12 F, 36; 75/123 E, 75/123 N, 123 J

[56] References Cited

U.S. PATENT DOCUMENTS 3,997,372 12/1976 Matas et al. ..... 148/36

FOREIGN PATENT DOCUMENTS 53-70914 6/1978 Japan ..... 148/36

OTHER PUBLICATIONS

Bosley et al., Steel Ladle Practices for Desulfurization and Sulfide Morphology Control at U.S. Steel, pp. 28–37.

*Primary Examiner*—Peter K. Skiff

*Attorney, Agent, or Firm*—Merriam, Marshall & Bicknell

[57] ABSTRACT

A hot rolled, high strength, low alloy steel strip is prepared from a steel having a controlled composition employing small quantities of Cb and V, and the steel is renitrogenized. Deliberate Si addition is avoided. The carbon and manganese contents are controlled, and a sulfur controlling agent is employed. Hot rolling practice is controlled. The hot rolled steel strip has a microstructure consisting essentially of a ferrite matrix with scattered pearlite, a relatively fine ferrite grain size and excellent yield strength and ductility.

13 Claims, No Drawings

HOT ROLLED STEEL PRODUCT AND METHOD FOR PRODUCING SAME

BACKGROUND OF THE INVENTION

The present invention relates generally to rolled steel products and more particularly to a hot-rolled, high strength low alloy steel strip.

The hot rolling of steel strip is performed in a rolling mill containing a series of rolling stands through which passes the hot steel product undergoing rolling. The initial group of rolling stands is the roughing train in which the steel product undergoes reduction to a strip of intermediate thickness. The final group of rolling stands is the finishing train in which the strip is reduced to its final thickness. Each rolling stand includes at least two rolls maintained a predetermined distance apart and between which passes the product undergoing rolling.

Hot rolled, high strength, low alloy steel strip has many uses, particularly in the automotive industry because automobile parts fabricated from this strip have relatively high strength properties at a relatively reduced thickness, and reducing the thickness of a part reduces its weight. A reduction in weight reduces the fuel consumption of an automobile made from these parts. When the yield strength exceeds 550 MPa or 80,000 psi (80 ksi), it can be readily utilized by the automotive industry in thicknesses down to 0.065 in. (1.65 mm) or less.

Most commercial hot rolled steel strips meeting the requirements described in the preceding sentence employ columbium and/or vanadium, both in relatively small quantities, together with a relatively high silicon content (at least 0.2 wt.%).

Examples of prior art patents which disclose embodiments of hot-rolled steel strip having high strength, low alloy characteristics include *Korchynsky et al.* U.S. Pat. No. 3,666,570, which discloses the use of either columbium or vanadium for strengthening purposes. *Hamburg et al.* U.S. Pat. No. 4,033,789 and *Matas et al.* U.S. Pat. No. 3,997,372 each disclose the use of both columbium and vanadium together but also employs a relatively high silicon content (at least 0.2 wt.%). *Abraham et al.* U.S. Pat. No. 4,142,922 discloses a hot-rolled steel strip employing both columbium and vanadium, together with a relatively low manganese content (e.g., 0.3–0.5 wt.%). *Aronson et al.* U.S. Pat. No. 3,661,537 discloses a welded pipe structure composed of steel containing columbium plus vanadium but requires a relatively high carbon content (e.g., 0.1–0.2 wt.%).

The hot-rolling of light gauge, high strength, low alloy steel strip is very difficult because very high roll separating forces and high rolling mill motor electric currents are experienced in the finishing train of rolling stands. Columbium, vanadium and silicon, while strengthening the steel, all contribute to the problem described in the preceding sentence. In order to make practicable the production of light gauge, high strength, hot rolled steel strip, the steel composition must be controlled so as to minimize rolling mill loads while attaining the desired strength levels in the finished, hot rolled steel product.

Another problem in hot rolled, high strength, low alloy steel strip is the presence of sulfide inclusion which, unless eliminated or shape-controlled, have an adverse effect on the properties of the hot rolled steel strip.

SUMMARY OF THE INVENTION

A hot-rolled steel strip produced in accordance with the present invention embodies the desired strength characteristics, together with other desirable physical properties, and it may be hot-rolled down to a thickness of 0.065 in. (1.65 mm) without presenting undue rolling mill problems.

More particularly, in the steel's composition, controlled quantities of columbium and vanadium are utilized, and the steel is renitrogenized. Deliberate silicon additions are avoided. The carbon and manganese contents are controlled, and a sulfur-controlling agent is employed.

In one embodiment, the sulfur controlling agent may be a rare earth metal or mischmetal, both of which control the sulfide shape in the microstructure of the steel, in a conventional manner. In another embodiment, the sulfur-controlling agent may be magnesium which reduces the presence of sulfur in the steel, during the steel-making process, or it may be calcium, which both reduces the presence of sulfur and controls the sulfide shape.

In addition to controlling the composition of the steel, the hot-rolling practice is controlled in a manner which, in combination with the particular composition selected for the steel, produces a hot-rolled steel strip having a microstructure consisting essentially of a ferrite matrix as a major portion and scattered pearlite as a minor portion, with a ferrite grain size at least as fine as ASTM 12, a yield strength of at least 550 MPa (80 ksi) and an elongation of at least 20% in 2 in (5 cm).

Other features and advantages are inherent in the product and method claimed and disclosed or will become apparent to those skilled in the art from the following detailed description.

DETAILED DESCRIPTION

A hot-rolled steel strip in accordance with an embodiment of the present invention is produced from a steel composition consisting essentially of, in wt.%:

carbon—0.04–0.08
manganese—1.1–1.6
columbium—from about 0.03 to less than about 0.08
vanadium—0.08–0.1
nitrogen—0.013–0.020
silicon—less than 0.05
sulfur—less than 0.02
phosphorus—less than 0.02
aluminum—0.02–0.10
iron—essentially the balance Columbium and vanadium are added to improve the yield strength of the steel. Both act as grain refiners. Upper limits are placed on these elements to avoid an undue load on the rolls in the finishing train of the rolling mill, as described above, and, for this same reason, silicon is maintained at residual amounts. Nitrogen is added for strengthening purposes, as it combines with vanadium to produce vanadium nitride precipitates which promote the formation of fine grained austenite during soaking of the steel prior to hot rolling, and this acts to strengthen the steel.

An upper limit is placed on the carbon content because, if carbon is too high, the columbium will not go into solution in austenite during soaking, and complete solution of the columbium is essential if the potential of the columbium for increasing yield strength is to be fully utilized. The lower limit on carbon is selected for strength purposes. If the carbon content is too low, the steel will have relatively low yield and ultimate tensile strengths with the elastic ratio approaching 1.0. This will occur even if the columbium goes completely into solution during soaking. Preferably the carbon content is in the range 0.06–0.08 wt.%.

The manganese upper limit is selected to prevent the formation of bainitic products and to help provide in the hot rolled steel strip a microstructure consisting essentially of ferrite grains, as a major portion, and scattered pearlite as a minor portion. The manganese lower limit is selected to maintain a relatively fine ferrite grain size. Lowering the manganese content increases the ferrite grain size.

The upper limits on sulfur and phosphorus are selected to enhance ductility and toughness.

The composition described above is achieved in the ladle in which the molten steel is contained before casting into a solid shape, e.g., an ingot or a slab. The steel's composition also includes a sulfur controlling agent which may be one of the rare earths, mischmetal or combinations thereof. The rare earths and the mischmetal may be added to the casting mold or ladle. They control the shape of the sulfide inclusions in the steel, and they should be present in an amount equal to at least about 1.5 times the sulfur content.

The sulfur controlling agent may also be calcium or magnesium or combinations thereof. Mg and Ca are added to the steel in the ladle and reduce the S content of the steel. Ca also controls the shape of the sulfide inclusions. Ca is present in the finished steel product in the range of about 20–100 parts per million (ppm), while Mg is present in the finished steel product in a range from almost undetectable, but greater than zero, up to about 20 ppm. Controlling the sulfur content with Ca or Mg improves a weldability of the steel compared to that obtained when rare earths or mischmetal are employed as the sulfur controlling agent. Improved weldability resulting from the employment of Ca or Mg as a sulfur controlling agent facilitates maintaining a low silicon content.

The steel is aluminum killed, ingot cast or continuous cast and solidified respectively into an ingot or slab, depending upon the casting practice employed.

When the steel is cast into an ingot, the ingot is hot-rolled into a slab, employing conventional slabbing practice, with a slab finishing temperature of about 1120° C. (2050° F.). The slab is hot machine scarfed, cooled and then further conditioned, employing conventional conditioning practice, to improve the surface condition of the slab. At this stage, the slab has a thickness typically in the range $6\frac{1}{2}$–$8\frac{1}{4}$ in. (16.5–21.0 cm). The maximum slab thickness would be a function of the hot mill reheating furnace capability. Preferably the slab is about $7\frac{1}{2}$ in. (19.05 cm) thick.

The slab is typically reheated or soaked for about $2\frac{1}{4}$ to $2\frac{1}{2}$ hours or sufficient time to assure a complete soaking of the slab and a complete solution of the columbium in the steel. At the conclusion of soaking, the slab has a mean temperature in the range of about 1204° to 1316° C. (2200° to 2400° F.). Preferably the slab has a mean temperature of 1260° C. (2300° F.). Because of the thickness of the slab, the temperature will vary from the surface to the interior of the slab, and because of this temperature gradient in the slab, the temperature thereof is expressed as a mean temperature.

After soaking, the hot slab is hot-rolled initially to produce an intermediate strip having a thickness substantially less than that of the slab but substantially greater than the desired final thickness of the strip. Hot-rolling the slab into the intermediate strip occurs in a roughing train typically consisting of five rolling stands. The intermediate product exiting from the last roughing stand has a thickness typically in the range 0.9–2 inches (2.3–5.1 cm), preferably about 1 in. (2.5 cm). The temperature of the intermediate strip as it exits the last roughing stand is typically greater than about 1049° C. (1920° F.).

The intermediate strip which exits from the roughing train is then subjected to end cropping. After end cropping, the strip is subjected to finish hot-rolling in a finishing train to reduce the strip to its desired final thickness. There are no substantial deliberate delays between the last stand in the roughing train and the first stand in the finishing train, except that there is approximately a 45 second interval of transfer time between the roughing train and the finishing train during which interval end cropping also occurs.

The intermediate strip entering the finishing train has a strip temperature no less than about 982° C. (1800° F.), and the strip which exits from the finishing train has a temperature no less than about 899° C. (1650° F.). Typically, the intermediate strip has a strip temperature, at the beginning of finish hot-rolling, in the range 982° C.–1010° C. (1800°–1850° F.), and the finished strip, exiting from the finishing train, has a strip temperature in the range 899°–927° C. (1650°–1700° F.). The thickness of the strip after finishing is typically in the range 0.065–0.375 in. (0.165–0.94 cm).

After it leaves the finishing train, the hot strip is cooled to a strip temperature below about 621° C. (1150° F.). The strip is cooled with a liquid coolant, conventionally employing either high pressure water sprays or solid sheets or curtains of water. The cooling rate is in the range of about 11°–36° C./sec (20°–65° F./sec). Preferably the cooling rate is about 28° C./sec (50° F./sec).

After cooling, the strip is collected (e.g., coiled) at a strip temperature below about 621° C. (1150° F.), preferably at a strip temperature of about 583° to 621° C. (1050°–1150° F.).

The hot rolled steel strip thus produced has a microstructure consisting essentially of a ferrite matrix as a major portion and scattered pearlite as a minor portion, with small iron carbide particles at the grain boundaries. The strip has a ferritic grain size ranging from ASTM 12 (at 0.03% columbium) to 14 (at 0.075% columbium). Although 0.075% columbium may be employed, for most purposes a columbium content in the range 0.03–0.04 wt.% is preferred in order to minimize rolling loads.

Among the physical properties of the strip are an ultimate tensile strength greater than 620 MPa (90 ksi), a yield strength greater than 550 MPa (80 ksi) and a ductility, expressed an elongation in 2 in. (5 cm), of 20% or higher.

For a given finishing temperature in the range 899°–927° C. (1650°–1700° F.), the toughness of the strip increases with increased columbium content. For example, with a columbium content of 0.07 wt.%, a $\frac{3}{8}$ in. thick strip has a Charpy V-notch impact transition temperature, at 15 ft/lbs, of less than −40° F. (−40° C.). As the columbium content decreases from 0.07 wt.% to 0.03 wt.%, the transition temperature increases from −40° F. up to about 0° F. (18° C.).

The foregoing detailed description has been given for clearness of understanding only, and no necessary limitations should be understood therefrom, as modifications will be obvious to those skilled in the art.

We claim:

1. A hot-rolled steel strip having a composition consisting essentially of, in wt.%:
carbon—0.04–0.08
manganese—1.1–1.6
columbium—from about 0.03 to less than about 0.08
vanadium—0.08–0.1
nitrogen—0.013–0.020
silicon—less than 0.05
sulfur—less than 0.02
phosphorus—less than 0.02
aluminum—0.02–0.10
iron—essentially the balance
said steel strip having a microstructure consisting essentially of a ferrite matrix as a major portion and scattered pearlite as a minor portion;
said composition including a sulfur controlling agent;
said microstructure having a ferrite grain size at least as fine as ASTM 12;
said steel strip having a yield strength of at least 80 ksi (545 MPa), and an elongation of at least 20% in 2 inches (5 cm).

2. A hot-rolled steel strip as recited in claim 1 wherein:
said sulfur controlling agent is selected from the group consisting of (a) 20 to 100 ppm calcium (b) greater than zero but less than 20 ppm magnesium and (c) combinations thereof.

3. A hot rolled steel strip as recited in claim 1 wherein:
said sulfur controlling agent is selected from the group consisting of the rare earth metals, mischmetal and combinations thereof;
and the ratio of said controlling agent to sulfur is at least about 1.5.

4. A hot rolled steel strip as recited in claim 1 wherein:
said carbon content is 0.06–0.08 wt.%;
and said columbium content is 0.03–0.04 wt.%.

5. A hot rolled steel strip as recited in claim 1 and having a thickness in the range 0.065–0.375 in. (0.165–0.94 cm).

6. A method for producing a hot rolled steel strip having a microstructure consisting essentially of a ferrite matrix as a major portion and scattered pearlite as a minor portion, a ferrite grain size at least as fine as ASTM 12, a yield strength of at least 80 ksi (550 MPa) and an elongation of at least 20% in 2 inches (5 cm), said method comprising the steps of:
providing a steel slab having a composition consisting essentially of, in wt.%:
carbon—0.04–0.08
manganese—1.1–1.6
columbium—from about 0.03 to less than about 0.08
vanadium—0.08–0.1
nitrogen—0.013–0.020
silicon—less than 0.05
sulfur—less than 0.02
phosphorus—less than 0.02
aluminum—0.02–0.10
iron—essentially the balance
said composition including a sulfur controlling agent;
heating said slab to a mean slab temperature in the range of about 1204° to 1316° C. (2200° to 2400° F.);
hot rolling said slab to produce an intermediate strip having a thickness substantially less than said slab but substantially greater than the desired final thickness of said strip, said intermediate strip having a strip temperature, at the end of said hot rolling step, greater than about 1049° C. (1920° F.);
cropping the ends from said intermediate strip;
subjecting said intermediate strip to finish hot rolling to reduce said strip to said desired final thickness;
said intermediate strip having a strip temperature no less than about 982° C. (1800° F.) at the beginning of said finish hot rolling, and said strip having a strip temperature no less than about 899° C. (1650° F.) at the end of the finish hot rolling;
cooling said strip after said finish hot rolling to a strip temperature below about 621° C. (1150° F.);
and collecting said strip at a strip temperature below about 621° C. (1150° F.).

7. A method as recited in claim 6 wherein:
said steel slab has a thickness of $6\frac{1}{2}$ to $8\frac{1}{4}$ in. (16.5 to 21.0 cm.) before hot rolling;
said hot rolling comprises producing an intermediate strip having a thickness of 0.9 to 2 in. (2.3 to 5.1 cm.)
and said finish hot rolling reduces the strip thickness to 0.065–0.375 in. (0.165–0.94 cm.).

8. A method as recited in claim 6 wherein:
said sulfur controlling agent is selected from the group consisting of (a) 20 to 100 ppm calcium (b) greater than zero but less than 20 ppm magnesium and (c) combinations thereof.

9. A method as recited in claim 6 wherein:
said sulfur controlling agent is selected from the group consisting of the rare earth metals, mischmetal and combinations thereof;
and the ratio of said controlling agent to sulfur is at least about 1.5.

10. A method as recited in claim 6 wherein:
said columbium content is 0.03–0.04 wt.%.

11. A method as recited in claim 6 wherein said cooling step comprises:
contacting said strip with a liquid coolant to provide a cooling rate of about 11° to 36° C./sec (20°–65° F./sec).

12. A method as recited in claim 11 wherein:
said collecting step is performed at a strip temperature of about 583° to 621° C. (1050°–1150° F.).

13. A method as recited in claim 6 wherein:
said collecting step is performed at a strip temperature of about 583° to 621° C. (1050°–1150° F.).

* * * * *